US006745541B2

(12) United States Patent
Sakurazawa

(10) Patent No.: US 6,745,541 B2
(45) Date of Patent: Jun. 8, 2004

(54) LID FEEDING APPARATUS

(75) Inventor: Hatsuo Sakurazawa, Takasaki (JP)

(73) Assignee: Fuji Manufacturing Corporation Ltd. (JP)

( * ) Notice: Subject to any disclaimer, the term of this patent is extended or adjusted under 35 U.S.C. 154(b) by 0 days.

(21) Appl. No.: 10/297,684

(22) PCT Filed: Jun. 19, 2001

(86) PCT No.: PCT/JP01/05226

§ 371 (c)(1),
(2), (4) Date: Jun. 12, 2002

(87) PCT Pub. No.: WO02/04293

PCT Pub. Date: Jan. 17, 2002

(65) Prior Publication Data

US 2003/0131559 A1 Jul. 17, 2003

(30) Foreign Application Priority Data

Jul. 6, 2000 (JP) ..... 2000-204801

(51) Int. Cl.[7] ..... B65B 7/28
(52) U.S. Cl. ..... 53/307; 53/287; 53/306
(58) Field of Search ..... 53/287, 299, 306, 53/307

(56) References Cited

U.S. PATENT DOCUMENTS

| | | | | |
|---|---|---|---|---|
| 2,836,328 A | | 5/1958 | Kinney | 221/211 |
| 3,717,971 A | | 2/1973 | Naggert | 53/89 |
| 3,876,196 A | | 4/1975 | Naggert | 269/304 |
| 3,894,379 A | | 7/1975 | Naggert | 53/40 |
| 4,703,607 A | * | 11/1987 | Propper et al. | 53/307 |
| 4,866,907 A | * | 9/1989 | Iuchi et al. | 53/299 |
| 5,946,886 A | * | 9/1999 | Bealer | 53/307 |
| 6,161,367 A | * | 12/2000 | Walter | 53/307 |

FOREIGN PATENT DOCUMENTS

| | | |
|---|---|---|
| JP | 54085899 A | 7/1979 |
| JP | 148001 | 10/1980 |
| JP | 04294706 A | 3/1991 |

* cited by examiner

*Primary Examiner*—John Sipos
(74) *Attorney, Agent, or Firm*—Young & Basile, P.C.

(57) ABSTRACT

To provide a lid feeding apparatus which permits reduction in apparatus and maintenance costs, and safe feeding of a lid onto an opening end of a vessel with high accuracy. The lid feeding apparatus includes: a transporting device 2 for intermittently transporting a vessel N with its opening end upward; a lid stocking device 4 holding layers of numbers of laminar lids; a lid feeding mechanism 6 in which one lid is sucked out of the lid stocking device 4, transferred above the opening end of the vessel transported by the transporting device, and fed onto the opening end by being released from suction. There are provided, near the lid stocking device 4, a lid guiding portion 40 for guiding the lid so as to be separated from a lid sucking mechanism to cover the opening end, and a guide portion moving mechanism 46 for moving the lid guiding portion 40 to a level of the opening end of the vessel just before releasing suction of the lid by the lid feeding mechanism.

5 Claims, 7 Drawing Sheets

LID FEEDING APPARATUS

TECHNICAL FIELD

The present invention relates to a lid feeding apparatus for automatic feeding of a lid onto an opening portion of a vessel which contains dry noodles or the like.

BACKGROUND ART

A known apparatus for automatic feeding of a lid onto a vessel is the one in which one lid is sucked out of numbers of lids held in a lid stocking device by a suction feeding means or the like, transferred above the vessel transported with its opening end upward by a transporting device, and fed onto the opening end by being released from suction.

In such an apparatus, the lid separated and dropped down from the suction feeding means is unlikely to be properly fed onto the opening end of the vessel.

Therefore, a configuration as disclosed in Japanese Utility Model Laid-Open No. 55-148001 specification is known, in which a plurality of dies holding vessels on a transporting device are provided with guide members for guiding lids onto opening ends of the vessels.

The above described dies are in the form of plates having a plurality of vessel supporting holes for supporting vessels with their opening ends upward, and a plurality of guide pins as the guide members are arranged on top surfaces of the dies around the vessel supporting holes. Each guide pin is a member with a head inclined toward the vessel supporting hole and is supported by a spring arranged in the plate so that the guide pin can be sunk in the die.

Arranging these guide pins permits the lid fed above the vessel by the suction feeding means to be guided by the guide pins and properly fed onto the opening end of the vessel.

The above described technique disclosed in Japanese Utility Model Laid-Open No. 55-148001 specification has, however, problems in apparatus and maintenance costs, since each die requires numbers of guide pins to be arranged thereon.

Further, in the worst case, the guide pins or the springs arranged near the opening end of the uncovered vessel might drop down into the vessel.

Moreover, the above described suction feeding means is likely to suck the lid in such a manner that a center of its sucking portion is offset from a center of the lid. When the lid is fed onto the opening end of the vessel in such a condition, proper feeding of the lid may not be attained even by the guide pins provided on the dies.

The present invention is achieved in view of the above conditions and has its object to provide a lid feeding apparatus which permits reduction in apparatus and maintenance costs, as well as safe feeding of the lid onto the opening end with high accuracy, correcting positions of the lid and the vessel.

DISCLOSURE OF THE INVENTION

The lid feeding apparatus according to the present invention comprises: a transporting device for intermittently transporting a vessel with its opening end upward; a lid stocking device holding layers of numbers of laminar lids; a lid feeding mechanism wherein one lid is sucked out of the lid stocking device, transferred above the opening end of the vessel transported by the transporting device, and fed onto the opening end by being released from suction; wherein, near the lid stocking device, the apparatus comprises: a lid guiding portion for guiding the lid such as to be separated from the lid sucking mechanism to cover the opening end; a guide portion moving mechanism for moving the lid guiding portion to the level of the opening end of the vessel immediately before releasing suction of the lid by the lid feeding mechanism.

Further, the guide portion moving mechanism is moved using driving force of the lid feeding mechanism. In addition, the lid guiding portion is in the form of a plate provided with a guide hole having a dimension almost identical to that of the lid, the plate moving upward and downward by driving the guide portion moving mechanism. Moreover, a mechanism for correcting a guide hole position is provided so as to match a center of the guide hole with an axis of the vessel. Furthermore, in the lid feeding apparatus, a tacking device is provided so as to tack a part of the lid on the opening end, when the lid is fed onto the opening end of the vessel.

BEST MODE FOR PRACTICING THE INVENTION

Embodiments of a lid feeding apparatus in which a lid is automatically fed onto a vessel containing dried noodles will be described with reference to the drawings.

Figure 1:
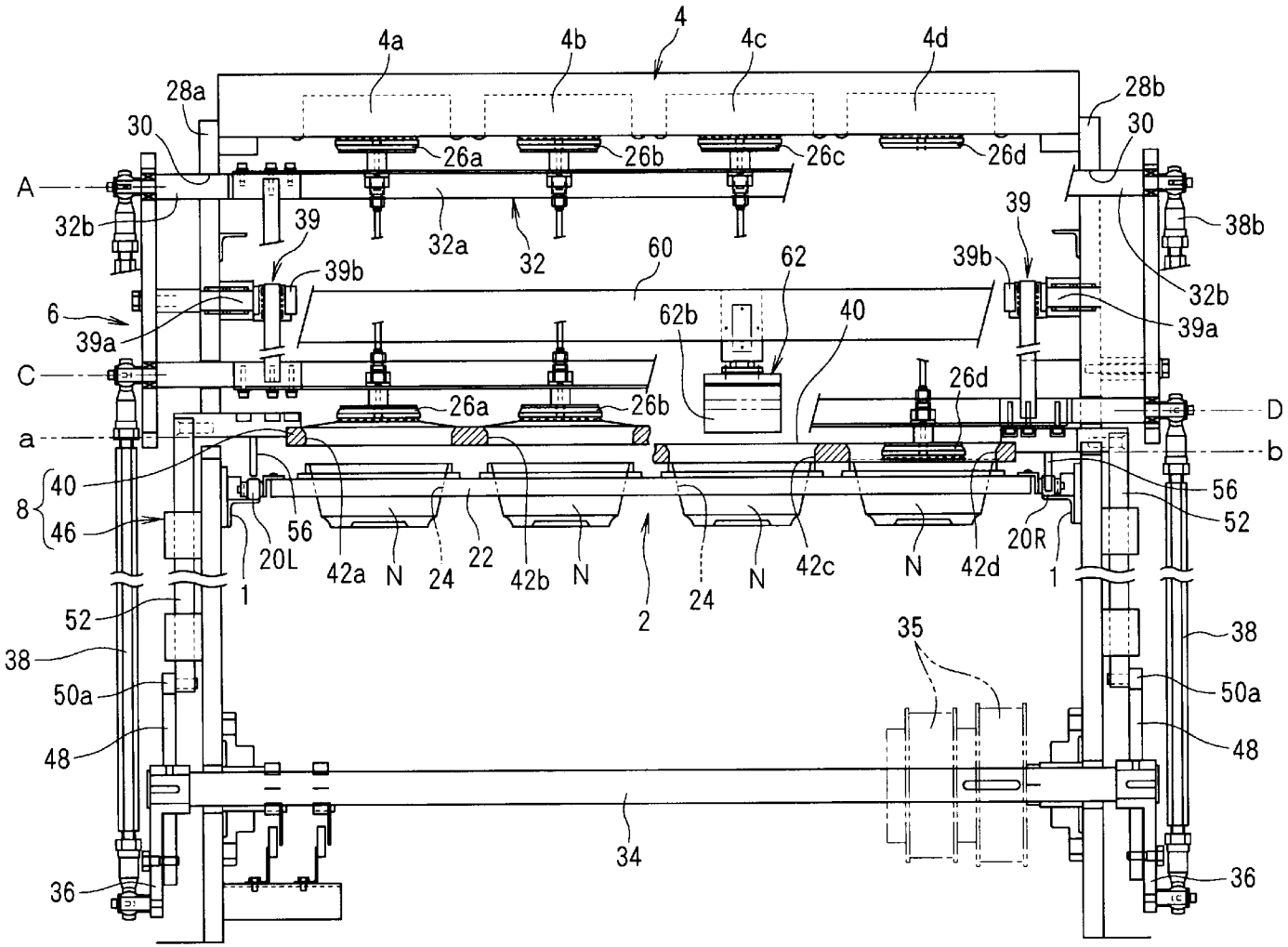
FIG. 1 is a view showing a lid feeding apparatus from a transporting direction.
Figure 2:
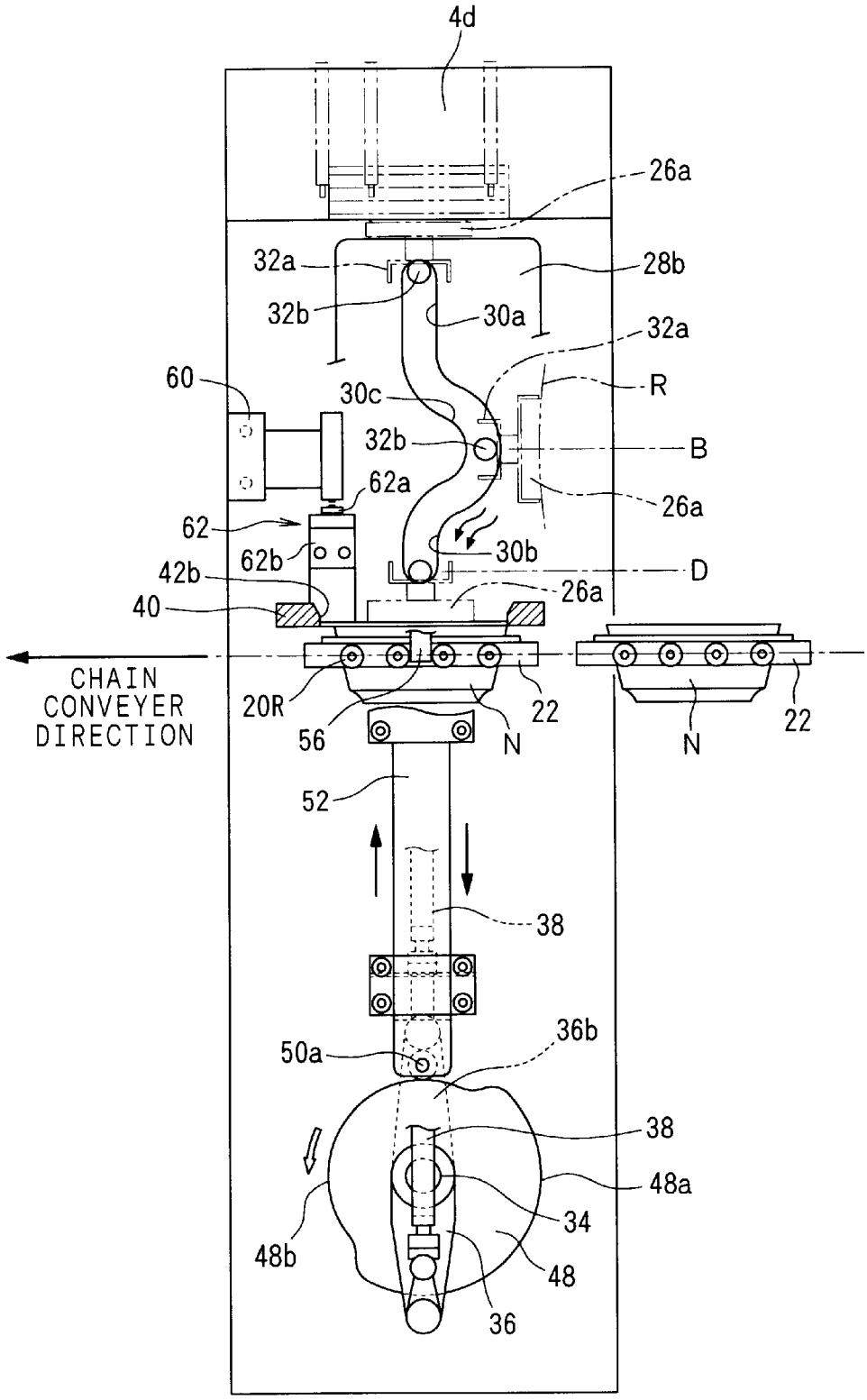
FIG. 2 is a schematic side view of the lid feeding apparatus.
Figure 3:
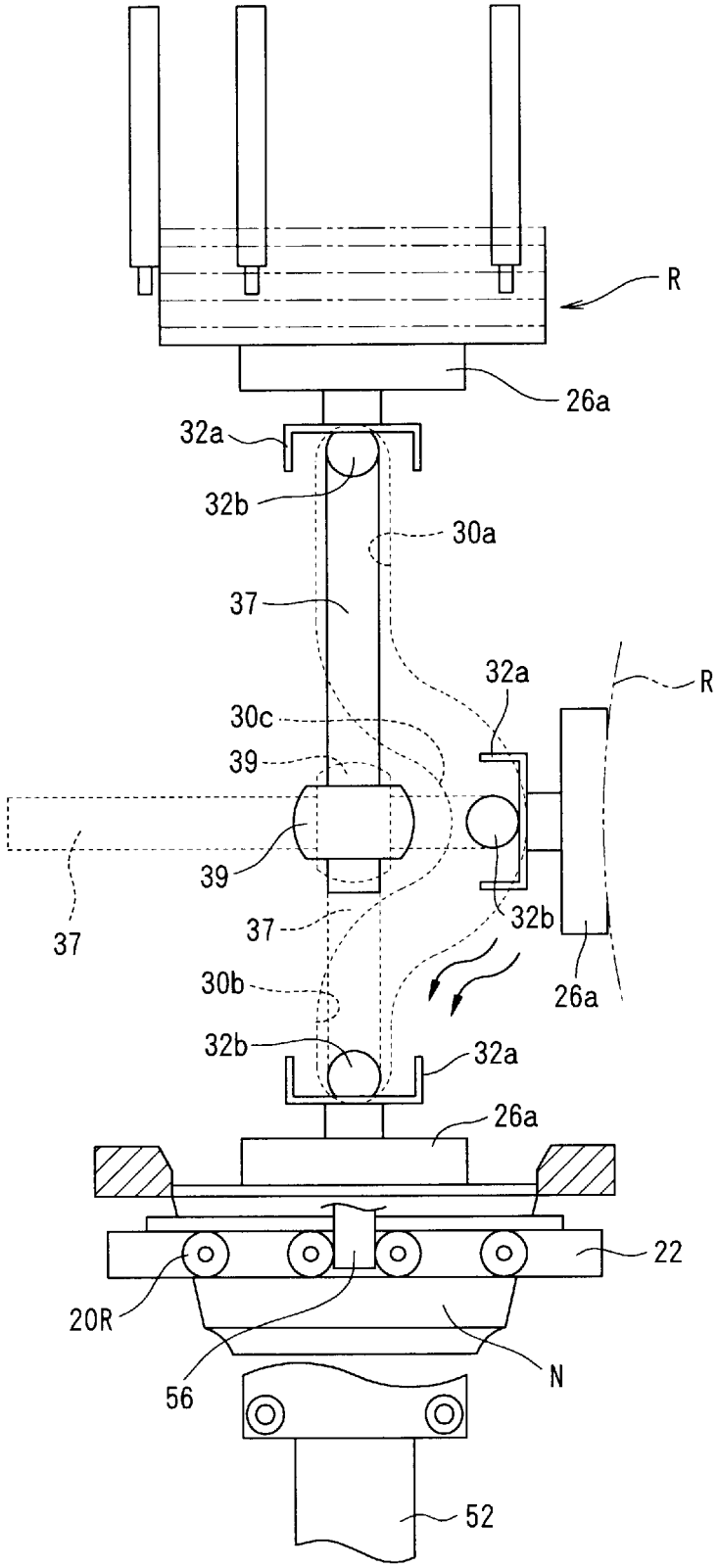
FIG. 3 is the schematic side view showing the configuration of the rotational movement mechanism for rotation motion of the sucking portion of the lid feeding apparatus.

FIG. 1 is a view showing a lid feeding apparatus from a transporting direction according to a first embodiment, FIG. 2 is a view of the apparatus shown from its right side, and FIG. 3 is a plan view showing a lid guiding portion 40 included in the apparatus according to this embodiment. A vessel N is formed from an insulative synthetic resin material such as expanded polystyrene in a shape of a bowl.

The apparatus according to this embodiment comprises: a chain conveyer 2 for intermittently transporting a vessel N containing the dried noodles; a lid stocking device 4 stocking numbers of lids R, each having a dimension slightly larger than that of an opening end of the vessel N; a lid feeding mechanism 6 for sucking one lid R and feeding the lid onto the opening end of the vessel N; and a lid guiding device 8 for guiding the lid R near the opening end of the vessel N.

As shown in FIG. 1, the chain conveyer 2 comprises: endless roller chains 20L guided left and 20R guided right by a guiding member 1, which are wrapped around a front end sprocket and a back end sprocket (not shown), respectively, to be conveyed; and a holding frame 22 bridged between the endless roller chains 20L and 20R. The holding frame 22 is formed, at its center in width direction, with holding holes 24 holding four vessels N at longitudinally spaced intervals. In addition, a regular rotational driving of the front end sprocket and the back end sprocket by a motor (not shown) brings the holding frame 22 having been moved from its back side in FIG. 1 holding the vessels N to a stop below a lid guiding portion 40 mentioned below.

The lid stocking device 4 is, as shown in FIG. 1, provided with four stocking portions 4*a* to 4*d* spaced longitudinally, holding layers of numbers of the laminar lids, and the lid at the lowest portion in each of the stocking portions 4*a* to 4*d* is in turn sucked by the lid feeding mechanism 6.

The lid feeding mechanism 6 is, as shown in FIG. 1, provided with: four sucking portions 26*a* to 26*d*, each of which sucks one lid at the lowest portion out of each of the stocking portions 4*a* to 4*d*; a suction supporting portion 32 comprising a channel member 32*a* holding four sucking portions 26*a* to 26*d* and a bar 32*b* coaxially fixed to both ends of the channel member 32*a*, the bar 32*b* being fitted in guide grooves 30 formed on a left supporting frame 28*a* and a right supporting frame 28*b*, to be arranged horizontally; a driving shaft 34 to which a rotational driving force is transmitted from a driving motor (not shown) through the chains and the sprockets 35; a pair of rotation levers 36 fixed, at their one-side ends, to both ends of the driving shaft 34; a pair of driving force transmitting shafts 38 rotatably connected between the other ends of the rotation levers 36 and the both ends of the suction supporting portion 32, which changes rotary motion of the driving shaft 34 into vertical motion. The guide groove 30 is, as shown in FIG. 2, provided, between an upper groove 30*a* extending upward and a lower groove 30*b* extending downward, with a curved groove 30*c* curved to be offset in width direction from centers of the upper groove 30*a* and the lower groove 30*b*.

And, when the driving force transmitting shafts 38 are moved upward to its top, the suction supporting portion 32 is positioned at its top (the position A in FIG. 1), and each of the upward sucking portions 26*a* to 26*d* sucks one lid R from each of the stocking portions 4*a* to 4*d*. When the driving force transmitting shafts 38 are moved downward and the bar 32*b* of the suction supporting portion 32 is moved downward to the curved groove 30*c* of the guide groove 30, the sucking portions 26*a* to 26*d* are rotated 90 degree (the position B in FIG. 2). Further, when the driving force transmitting shafts 38*a* and 38*b* are moved downward to their lowest part and the bar 32*b* of the suction supporting portion 32 is moved downward to the lower groove 30*b* of the guide groove 30 (the position C in FIG. 1), the sucking portions 26*a* to 26*d* are turned downward and moved downward to the holding frame 22 holding the vessels N (the position D in FIG. 1).

While the driving force transmitting shafts 38*a* and 38*b* are moving from its top to the lowest part, the bar 32*b* of the suction supporting portion 32 takes its position in the upper groove 30*a* so that the sucking portions 26*a* to 26*d* turn upward, then it takes its position in the curved groove 30*c* of the guide groove 30 so that the sucking portions 26*a* to 26*d* rotate 90 degrees, and lastly it takes its position in the lower groove 30*b* so that the sucking portions 26*a* to 26*d* turn downward. Consequently, the sucking portions 26*a* to 26*d* move rotationally. The mechanism enabling such rotational movement (hereinafter referred to as rotational movement mechanism) will be described referring to FIGS. 1 to 3.

The rotational movement mechanism, as shown in FIGS. 1 to 3, is performed by the supporting bar 37 and rotation supporting portion 39, and is constructed in, as is shown in FIG. 1, each of the supporting frame 28*a* and 28*b*. The configuration on the side of the supporting frame 28*b* will be described below. The supporting bar 37 is, as is shown in FIG. 3, a bar, one end of which is fixed on the bar 32*b*. This bar 37 is of designated length. This bar 37 is supported on the other end by the rotation supporting portion 39 and can slide freely.

The rotation supporting portion 39 is, as is shown in Fig, 1, is provided protruding on the supporting frame 28*b*. This rotation supporting portion 39 comprises the main portion 39*a* and rotating portion 39*b*, and the main portion 39*a* is fixed on the supporting frame 28*b*. The rotating portion 39*b* is fixed on the main portion 39*a*, which is fixed on the supporting frame 28*b* as described above, and can rotate freely.

The rotating portion 39*b* is fixed on the main portion 39*b* and can rotate freely, and the other end of the supporting bar 37 is fixed on the rotation supporting portion 39. The rotating portion 39*b* supports the supporting bar 37 to slide freely.

The supporting bar 37, by fixing the other end supported by the rotation supporting portion 39, makes the other end supported by the rotation supporting portion 39 the center of rotation at said rotation supporting portion 39, and the position of the other end supported by said rotation supporting portion 39 is supported to be changeable.

Namely, even though the center of the supporting bar 37 is fixed, the supporting bar 37 is supported in such a manner that the distance between the position where the supporting bar 37 is supported by the rotation supporting portion 39 and the sucking portions 26*a* to 26*d* can be changed.

As described above, the configuration that the supporting bar 37 is supported by the rotation supporting portion 39 is configured in each of the supporting frames 28*a* and 28*b*. Therefore, the rotational movement mechanism is performed. According to such rotational movement mechanism, the rotational mechanism accompanying the turn of direction of the sucking portions 26*a* to 26*d* as described below, is performed.

First, while the bar 32*b* of the suction supporting portion 32 is moving straight in the upper groove 30*a*, the supporting bar 37 is moved, sliding against the rotation supporting portion 39. Namely, the distance between the sucking portions 26*a* to 26*d* and the position where the supporting bar 37 is supported by the rotation supporting portion 39 is shortened. The movement of the sucking portions 26*a* to 26*d* at this time is a downward movement. Then, when the bar 32*b* of the suction supporting portion 32 is guided to the curved groove 30*c*, the movement of the supporting bar 37 is changed to the rotation movement, in addition to the sliding movement against the rotation supporting portion 39. The movement of the sucking portions 26*a* to 26*d* at this time is a rotational movement of 90 degrees, and a further turnover of 180 degrees.

And when the bar 32*b* of the suction supporting portion 32 is guided to the lower groove 30*b*, the only movement of the supporting bar 37 is again the sliding against the rotation supporting portion 39. Namely, the distance between the sucking portions 26*a* to 26*d* and the position where the supporting bar 37 is supported by the rotation supporting portion 39 is lengthened. The movement of the sucking portions 26*a* to 26*d* at this time is a downward movement in the state of looking downward. As described above, the rotation movement accompanying the turn of direction of the sucking portions 26*a* to 26*d* is performed by the rotational movement mechanism.

When the sucking portions 26*a* to 26*d* are turned downward by the rotational movement mechanism, the sucking portions 26*a* to 26*d* are released from suction of the lids R, and are moved downward such that the undersides of the lids R come to be the level of the opening ends of the vessels N.

The lid guiding device 8 is provided with a lid guiding portion 40 for guiding motion of the lids R after separated from the sucking portions 26*a* to 26*b* and before reaching the opening ends of the vessels N. The lid guiding portion 40, as shown in FIG. 3, is in the form of a plate provided with: four circular guide holes 42*a* to 42*d*, each having a shape almost identical to that of the lid R; and heater moving recesses 44*a* to 44*d* into which below-mentioned tacking heaters 62 are moved downward. The lid guiding portion 40 can be moved above the chain conveyer 2 or to the level of the opening ends of the vessels N by driving the guide portion moving mechanism 46.

A guide portion moving mechanism 46 comprises: as shown in FIGS. 1 and 2, a pair of cams 48 coaxial with the rotation levers 36 of the lid feeding mechanism 6 and fixed to both ends of the driving shaft 34; a pair of cranks 52 engaged, at their lower ends, with peripheral surfaces of the cams 48 through rollers 50*a*, and moved upward and downward by rotation of the cams 48; and connecting members 54 for connecting the upper portions of the cranks 52 with the both ends of the lid guiding portion 40.

When the rollers 50*a* roll on largest outer peripheral surfaces 48*a* of the cams 48 by rotation of the driving shaft 34, the cranks 52 are moved upward and the lid guiding portion 40 is positioned above the chain conveyer 2 (a position "a" in FIG. 1). When the rollers 50*a* roll on smallest outer peripheral surfaces 48*b* of the cams 48, the cranks 52 are moved downward so that the lower end of the lid guiding portion 40 comes to be the level of the opening ends of the vessels N (a position "b" in FIG. 1: a condition shown in FIG. 2).

As shown in FIG. 1, members 56 for correcting guide hole positions are provided on undersides of longitudinal both ends of the lid guiding portion 40. When the lid guiding portion 40 is moved downward, the members 56 for correcting guide hole positions, as shown in FIG. 2, are fitted in between the rollers included in the endless roller chains 20L and 20R so as to match each center of the guide holes 42*a* to 42*d* of the lid guiding portion 40 with a center of each of the holding holes 24 of the holding frame 22. Namely, the members 56 for correcting guide hole positions match each center of the guide holes 42*a* to 42*d* of the lid guiding portion 40 with axes of the vessels N.

Furthermore, four tacking heaters 62 fixed to a support frame 60 are positioned such as to face the heater moving recesses 44*a* to 44*d* of the lid guiding portion 40 above the lid guiding device 8. In the tacking heaters 62, cylinder rods 62*a* are extended vertically downward, so that the tacking heaters 62*b* are passed through the heater moving recesses 44*a* to 44*d* to be contacted with parts of the opening ends of the vessels N.

Next, operations of the above described embodiment will be described with reference to FIGS. 1 to 4.

Figure 5:
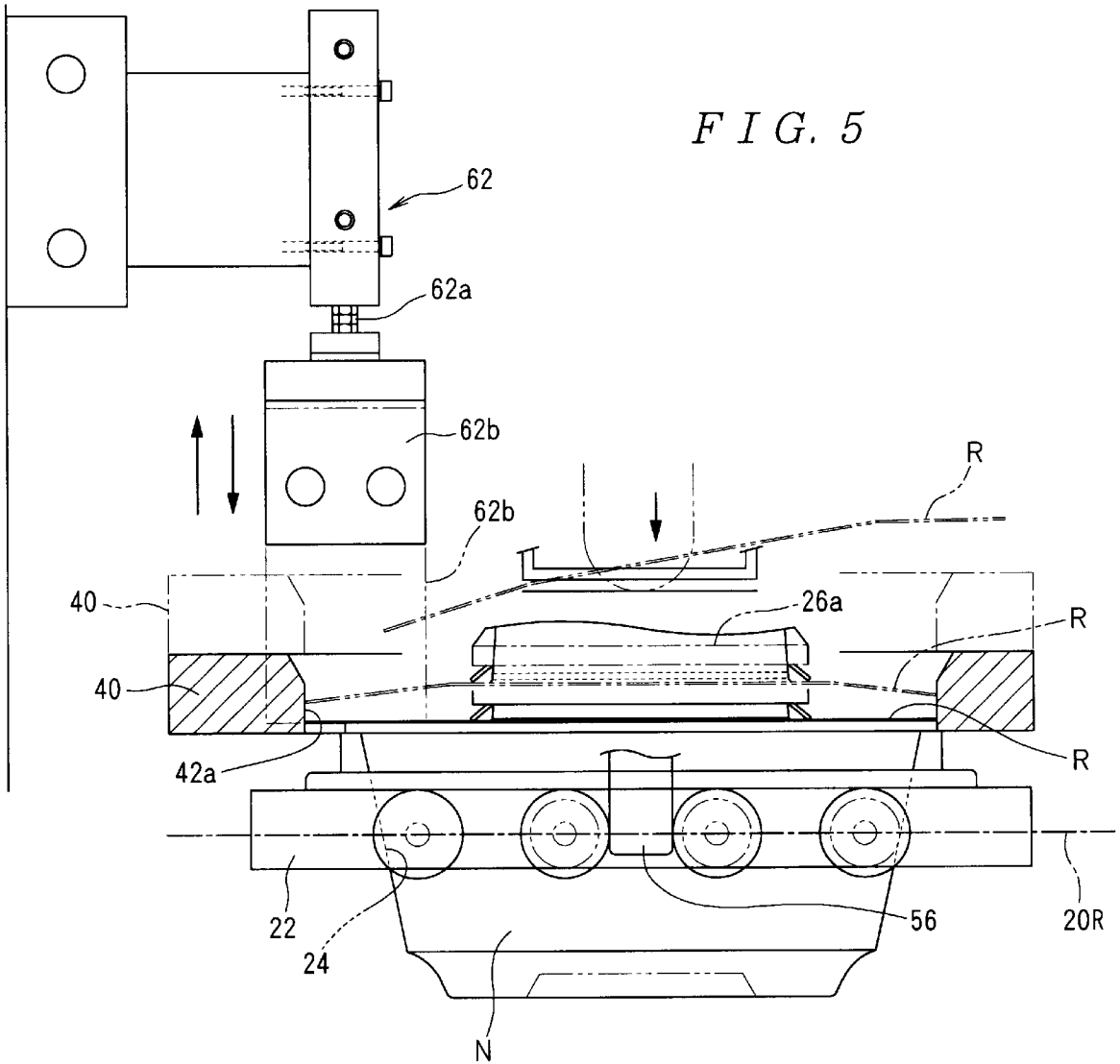
FIG. 5 is a view showing the state in which the fed lid is guided to the opening end of the vessel, in the lid feeding apparatus.

The descriptions are now made with respect to a condition where the chain conveyer 2 is stopped, where the driving force transmitting shafts 38 are moved upward to their top, and where the rollers 50*a* at the lower portions of the cranks 52 are abutted to the largest outer peripheral surfaces 48*a* of the cams 48 so that the lid guiding portion 40 is positioned above the holding frame 22 holding the vessels N (the position shown by dash-double dot line in FIG. 5).

And after each of the sucking portions 26*a* to 26*d* sucks one lid R out of the lid stocking device 4, the rotating force of the driving shaft 34 is transmitted to the rotation lever 36, thereby moving the driving force transmitting shaft 38 downward. Then, the sucking portions 26*a* to 26*d* are gradually turned downward guided by the guide grooves 30, holding the lids R. Synchronized with this operation, the rollers 50*a* at the lower portions of the cranks 52 change their rolling from the one on the largest outer peripheral surfaces 48*a* of the cam 48 to the one on the smallest outer peripheral surfaces 48*b*. Consequently, the cranks 52 are gradually moved downward and the lid guiding portion 40 is also moved downward such that its lower end comes to be the level of the opening end of the vessel N. At this time, the members 56 for correcting guide hole positions provided on the undersides of the lid guiding portion 40 are fitted in between the rollers of the endless roller chains 20L and 20R so as to match each center of the guide holes 42*a* to 42*d* of the lid guiding portion 40 with the axes of the vessels N.

Figure 4:
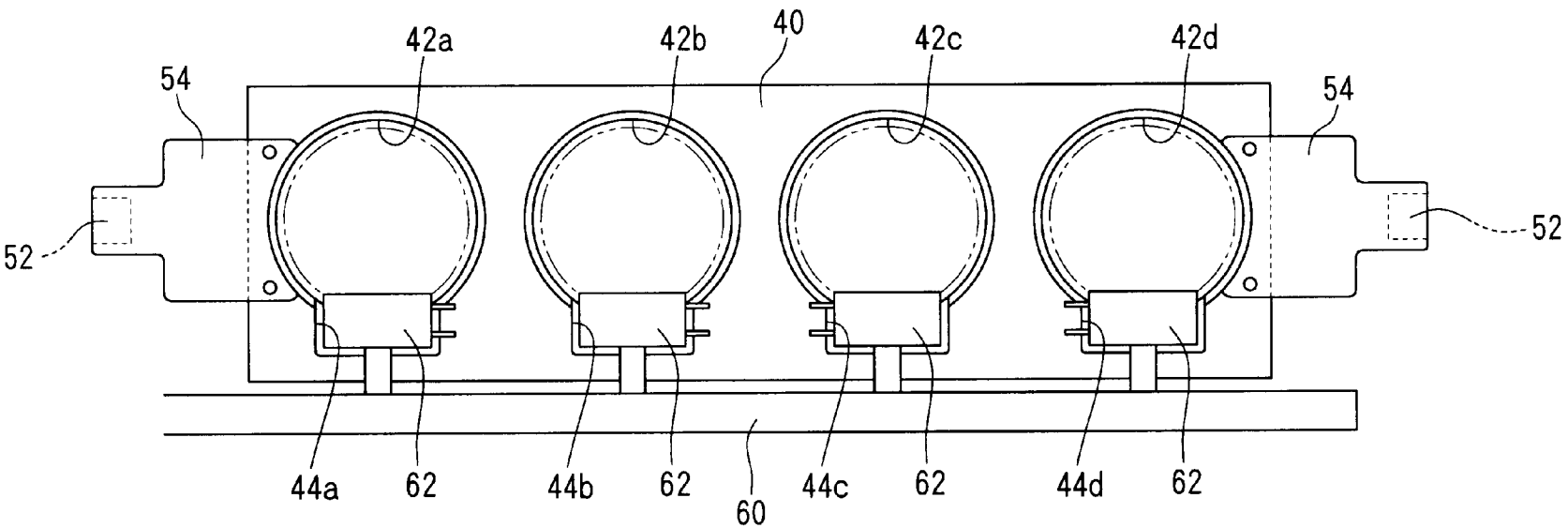
FIG. 4 is a plan view showing the lid guiding portion included in the lid feeding apparatus.

Suction of the lids R is released when the sucking portions 26*a* to 26*d* turn downward. As shown in FIG. 4, the lid R separated from the sucking portion 26*a* drops down such that its outer periphery keeps contact with an inner periphery of the guide hole 42*a* of the lid guiding portion 40, and that the center of the lid R is matched with the axis of the vessel N to surely cover the opening end.

After the sucking portion 26*a* to 26*d* are moved downward and hold the lids R of the vessels N to be flat, as shown by dash-double dot line in FIG. 5, the heater portions 62*b* of the tacking heaters 62 are moved downward to be contacted with parts of the lids R. According to this, the parts of the lids R are tacked on the opening ends of the vessels N by heating adhesion.

When the driving force transmitting shafts 38 are moved upward by rotation of the driving shaft 34, the sucking portions 26*a* to 26*d* are moved upward with rotation guided by the guide grooves 30. Synchronized with this operation, the rollers 50*a* at the lower portions of the cranks 52 change their rolling from the one on a smallest outer peripheral surfaces 48*b* to the one on a largest outer peripheral surfaces 48*a*. Consequently, the cranks 52 are gradually moved upward and the lid guiding portion 40 is also moved above the chain conveyer 2, resulting in returning to the primary condition.

Repeating the above described operations after intermittent movements of the chain conveyer 2 provides automatic feeding of the lids R onto the opening ends of the vessels N.

Thus, in the apparatus according to the present embodiment, just before the sucking portions 26*a* to 26*d* moved near the opening ends of the vessels N release suction of the lids R, the lid guiding portion 40 is moved downward to the level of the opening ends of the vessels N so that the lids R separated from the sucking portions 26*a* to 26*d* are guided to the opening ends of the vessels N. This reduces the number of components in comparison with a conventional apparatus wherein numbers of guide pins are arranged on transporting means (dies) to guide lids, and permits reduction in apparatus and maintenance costs.

Further, the lid guiding portion 40 arranged above the opening ends of the vessels N includes no small component likely to drop down into the vessels N, thereby increasing safety in automatic feeding of the lids.

The lid guiding portion 40 is in the form of a plate provided with the guide holes 42*a* to 42*d*, each having a shape almost identical to that of the lid R. In addition, the lid guiding portion 40 can be moved downward merely by being interlocked with the driving shaft 34 which drives the lid feeding mechanism 6, through the cams 48 and the cranks 52, thereby providing an apparatus with a simple configuration.

The members 56 for correcting guide hole position provided on the undersides of the lid guiding portions 40 are fitted in between the rollers of the endless roller chains 20L and 20R so as to match each center of the guide holes 42*a* to 42*d* of the lid guiding portion 40 with an axis of each vessel N, thereby permitting feeding of the lids R onto the opening ends of the vessel N with high accuracy.

In addition, for example, even if the lids R is sucked and fed with its center offset from the center of the sucking portion 26*a*, the lid R is corrected to be in its center position when it passes through the guide hole 42*a*. Accordingly, this case also permits feeding of the lid R onto the opening end of the vessel N with high accuracy.

Moreover, even if the fed lids R are deformed, for example turned to be curled, the sucking portions 26*a* to 26*d* having just released suction of the lids R are moved downward to the level of the opening ends of the vessels N so that the lids R fed onto the opening ends of the vessels N are pressed from above to be flat.

Furthermore, the lids R fed onto the opening ends of the vessels N are tacked, at their parts, on the opening ends of the vessels N by heating adhesion using the tacking heater 62, so that the lids R are unlikely to be offset from the proper positions of the opening ends of the vessels N, when transported to a next step.

Figure 6:
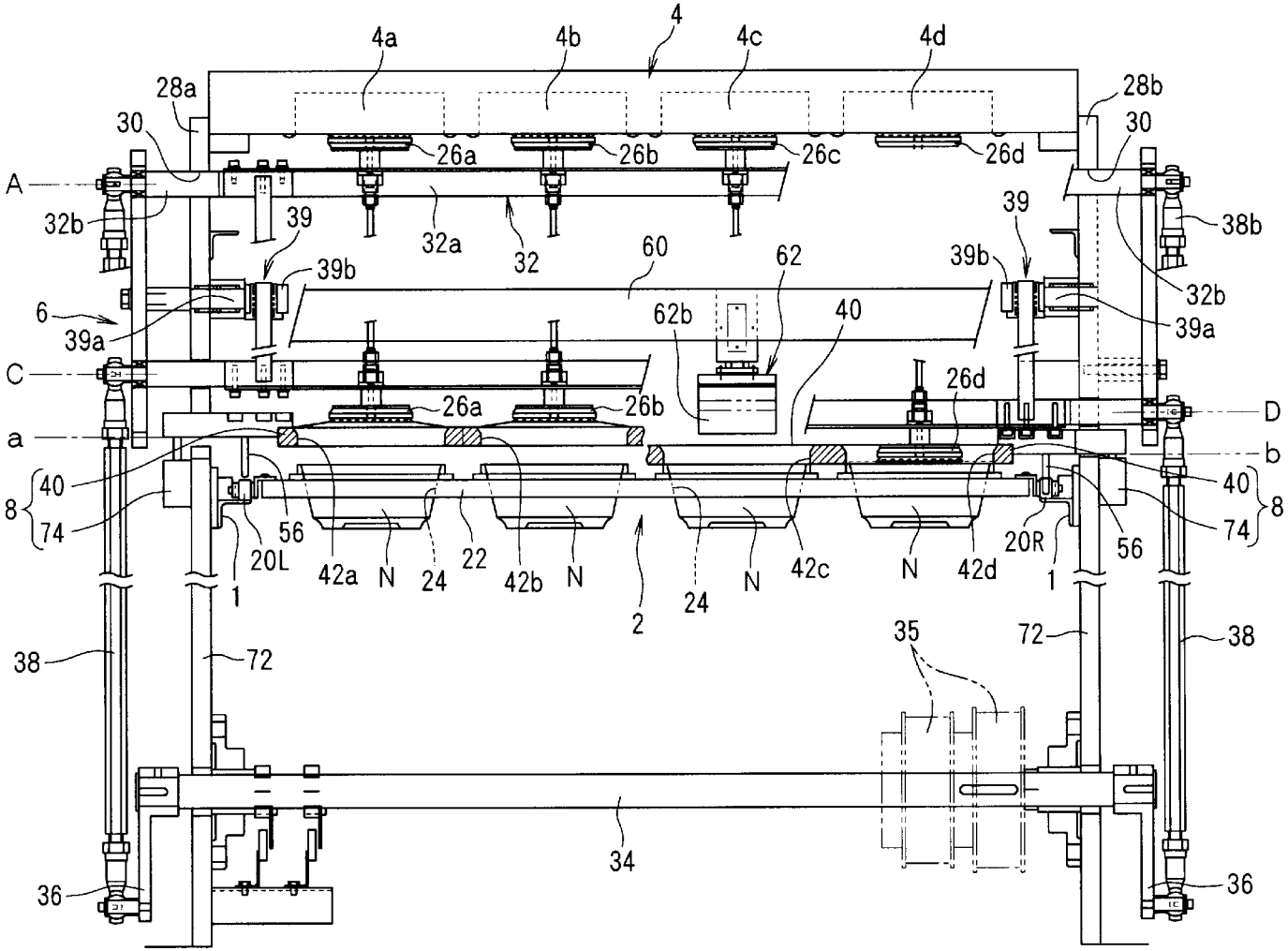
FIG. 6 is a view showing the lid feeding apparatus from a transporting direction according to other embodiments.

Next, FIG. 6 shows a lid feeding apparatus according to a second embodiment, in which the same component parts as in the first embodiment shown in FIG. 1 are referred to by the same reference numerals and their descriptions will be omitted.

This embodiment cancels a pair of cams 48 fixed to the both ends of the driving shaft 34 and the cranks 52 engaged with the peripheral surfaces of the cams 48 to be moved upward and downward, described in the first embodiment. Alternatively, guide portion moving cylinder devices 74 are fixed to apparatus frames 72, and the lid guiding portion 40 is moved upward and downward by operations of the guide portion moving cylinder devices 74.

Namely, after each of the sucking portions 26*a* to 26*d* suck one lid R out of the lid stocking devices 4 and before the driving force of the driving shaft 34 is transmitted to the rotation levers 36 to move the driving force transmitting shafts 38 downward, the guide portion moving cylinder device 74 positions the lid guiding portion 40 upward. Just before the sucking portions 26*a* to 26*d* turn downward, holding the lids R, the guide portion moving cylinder devices 74 move the lid guiding portion 40 downward such that its lower end comes to be the level of the opening ends of the vessels N.

Thereby, similarly as the first embodiment, this permits reduction in apparatus and maintenance. Further, the lid guiding portion 40 arranged above the opening ends of the vessels N include no small component likely to drop down into the vessel N, thereby increasing safety in automatic feeding of a lid R.

Figure 7:
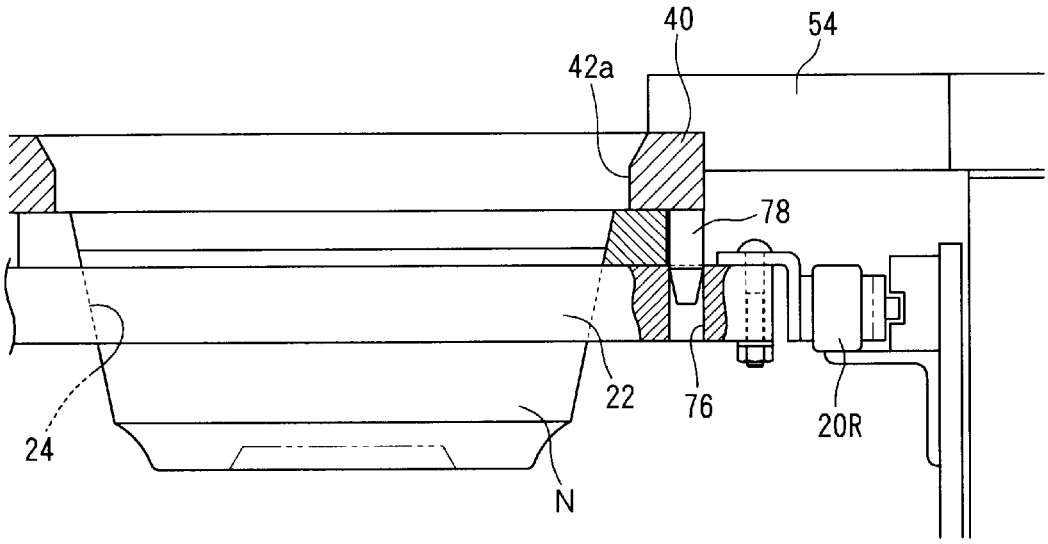
FIG. 7 is a view showing a mechanism for correcting a guide hole position of the lid feeding apparatus according to said other embodiments.

Next, FIG. 7 shows a third embodiment serving a function similar to that of the member 56 for correcting a guide hole position in the first embodiment.

In this embodiment, correction holes 76 are formed at the longitudinal both ends of the holding frame 22 bridged between the endless roller chains 20L and 20R, and correction protrusions 78 fitted in the correction holes 76 are provided on the undersides of the longitudinal both ends of the lid guiding portion 40.

When the lid guiding portion 40 is moved downward, the correction protrusions 78 are fitted in the correction holes 76 so as to match each center of the guide holes 42*a* to 42*d* of the lid guiding portion 40 with the center of each of the holding holes 24 of the holding frame 22. Namely, the correction holes 76 and correction protrusions 78 match each center of the guide holes 42*a* to 42*d* of the lid guiding portion 40 with the axes of the vessels N. The correction hole 76 and the correction protrusion 78 correspond to the mechanism for correcting the guide hole position according to the present invention.

Figure 8:
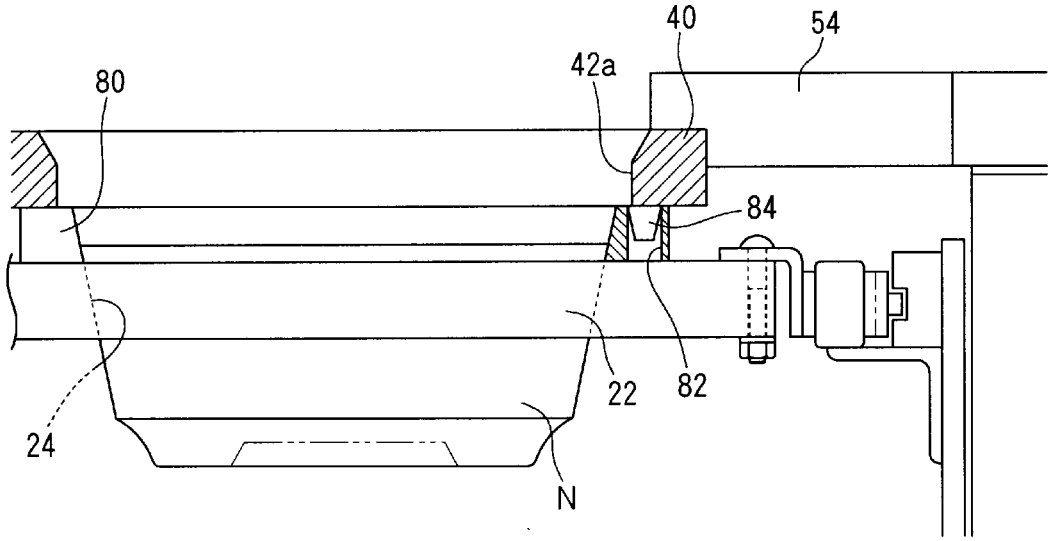
FIG. 8 is a view showing a mechanism for correcting a guide hole position of the lid feeding apparatus according to said other embodiments.

Furthermore, FIG. 8 shows an another mechanism for correcting a guide hole position, having a configuration different from the one shown in FIG. 7.

In this embodiment, correction holes 82 are formed at vessel holding rings 80 mounted on an upper opening peripheral edges of the holding holes 24 of the holding frame 22, and correction protrusions 84 fitted in the correction holes 82 are provided on the undersides of the longitudinal both ends of the lid guiding portion 40.

And, when the lid guiding portion 40 is moved downward, the correction protrusions 84 are fitted in the correction holes 82 so as to match each center of the guide holes 42*a* to 42*d* of the lid guiding portion 40 with the center of each of the holding holes 24 of the holding frame 22.

In the above embodiments, descriptions were made with respect to application to a manufacturing line of vessels containing dried noodles, but it is to be understood that the gist of the present invention is not limited to the embodiments, and that the present invention can also be applied to feeding of lids onto arbitrary packaging vessels. Further, the apparatus described in each of the above embodiments is the one for feeding the lids R to four vessels N at a time, but the number of the vessel N is not limited to this.

Industrial Applicability

The lid feeding apparatus according to the present invention permits reduction in apparatus and maintenance costs, and automatic feeding of a lid onto the opening end of the vessel with safety and high accuracy, correcting positions of the lid and the vessel.

What is claimed is:

1. A lid feeding apparatus, comprising:

a transporting device for intermittently transporting a vessel with its opening end upward;

a lid stocking device holding layers of numbers of laminar lids; and a lid feeding mechanism wherein one lid is sucked out of the lid stocking device, transferred above the opening end of said vessel transported by said transporting device, and fed onto said opening end by being released from suction, wherein, near said lid stocking device, the apparatus further comprises:

a lid guiding portion for guiding the lid such as to be separated from said lid sucking mechanism to cover said opening end; and a guide portion moving mechanism for moving the lid guiding portion to a level of the opening end of said vessel just before releasing suction of the lid by said lid feeding mechanism.

2. The apparatus according to claim 1, wherein said guide portion moving mechanism is interlocked with driving force of the lid feeding mechanism.

3. The apparatus according to claim 1, wherein the lid guiding portion is in the form of a plate provided with a guide hole having a dimension almost identical to that of said lid, the plate moving upward and downward by driving said guide portion moving mechanism.

4. The apparatus according to claim 3, wherein a mechanism for correcting a guide hole position is provided so as to match a center of said guide hole with an axis of said vessel.

5. The apparatus according to claim 1, wherein a tacking device is provided so as to tack a part of said lid on said opening end, when said lid is fed onto the opening end of said vessel.

* * * * *

UNITED STATES PATENT AND TRADEMARK OFFICE

CERTIFICATE OF CORRECTION

PATENT NO. : 6,745,541 B2
DATED : June 8, 2004
INVENTOR(S) : Hatsuo Sakurazawa

It is certified that error appears in the above-identified patent and that said Letters Patent is hereby corrected as shown below:

Title page,
Item [86], 371 (c)(1), (2), (4) Date, should read -- December 6, 2002 --

Signed and Sealed this

Twenty-eighth Day of December, 2004

JON W. DUDAS
*Director of the United States Patent and Trademark Office*